United States Patent [19]

McKinnon

[11] Patent Number: 4,779,743

[45] Date of Patent: Oct. 25, 1988

[54] BOOT RACK FOR WESTERN BOOTS WITH SIDE ATTACHED PULLSTRAPS

[76] Inventor: Jack McKinnon, 10138 SE. Lexington, Portland, Oreg. 97266

[21] Appl. No.: 33,530

[22] Filed: Apr. 3, 1987

[51] Int. Cl.[4] ..... A47F 5/08

[52] U.S. Cl. ..... 211/35; 211/106

[58] Field of Search ..... 211/34, 35, 87, 106

[56] References Cited

U.S. PATENT DOCUMENTS

| | | | |
|---|---|---|---|
| 180,192 | 6/1876 | Brown | 211/35 |
| 283,418 | 5/1883 | Ries | 248/303 |
| 782,346 | 1/1904 | Lantz | 24/343 |
| 2,400,807 | 5/1946 | Burkhard | 211/87 X |
| 2,515,293 | 7/1950 | Carter | 211/96 X |
| 3,249,231 | 5/1966 | Matlock | 211/35 |
| 4,149,290 | 4/1979 | Sansen | 211/34 X |

*Primary Examiner*—Robert W. Gibson, Jr.

[57] ABSTRACT

A rack (1) for hanging western boots (8) by their pullstraps (7) for storage, drying, protection, and display. The ends of the hangers (3) are turned inward toward each other to allow easy insertion into the pullstraps (7). The midsections of the hangers (3) drop to help hold the boots (8) on the rack (1). The rack (1) can be joined to another rack (1) by inserting the main body (2) into a joiner tube (5).

2 Claims, 1 Drawing Sheet

BOOT RACK FOR WESTERN BOOTS WITH SIDE ATTACHED PULLSTRAPS

BACKGROUND

1. Field of the Invention

This invention relates to a wall mounted rack for hanging western boots and other types of boots with side attached pullstraps or holes used for pulling the boot onto the foot.

2. Description of Prior Art

Although very few racks have been made for western boots the needs for said rack are many. The racks that have been made are awkward to use and not practicable.

One such rack consisted of a shaft that extended inside the boot to hold it in place while the sole rested on a peg. This rack was unsatisfactory because it was awkward to use and space consuming.

Another rack held a style of boot that had pullstraps in the front and rear of said boot rather than on the sides such as modern western boots.

No racks could be found that utilized side attached pullstraps for mounting boots. My rack is designed for the type of western boot made today that has side attached pullstraps or pullholes. Most users would find it desirable to have a rack that would be decorative, convenient, and easy to use.

OBJECTS AND ADVANTAGES

Accordingly I claim the following as my objects and advantages of the invention: to provide a western boot rack that could be easily mounted in various locations for the orderly storage, display, and protection of western boots.

The ensuing description and the accompanying drawing will show further advantages of the invention.

DRAWING FIGURES

DRAWING REFERENCE NUMERALS

Figure 1:
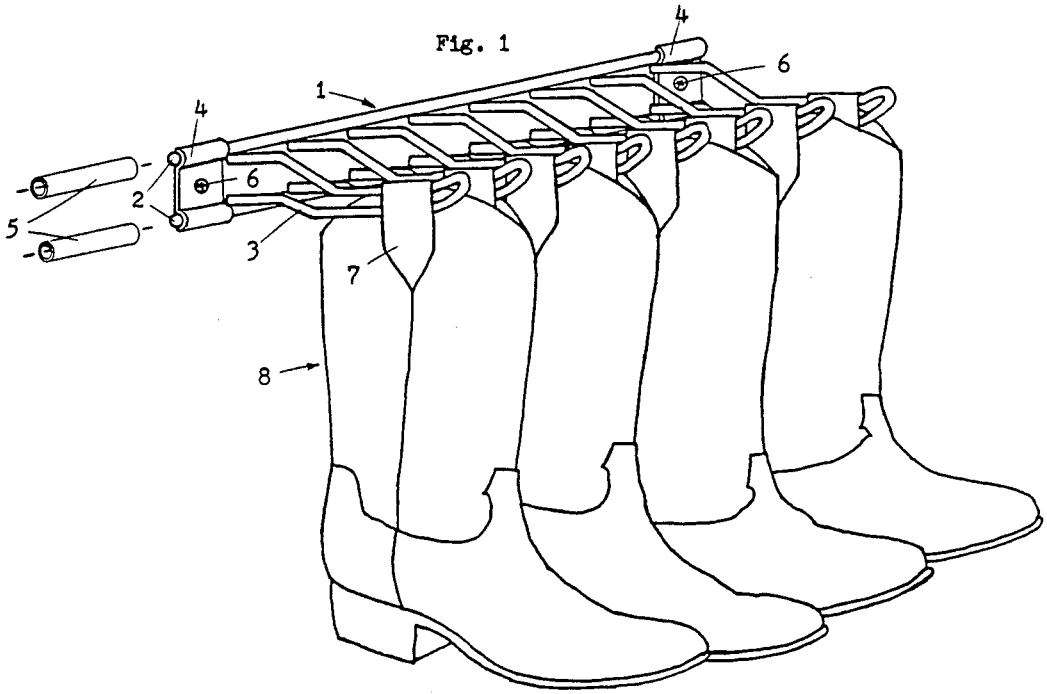
FIG. 1 shows a perspective side view of the rack with western boots mounted.

1 rack
2 main body
3 hanger
4 mounting clip
5 joiner tube
6 screw
7 pullstrap
8 boot

Rack Description

FIG. 1 shows the rack 1 mounted with boots 8 attached. The hanger 3 is slightly lowered through it,s midsection to keep the pullstraps 7 in place when mounted in a trailer.

Figure 2:
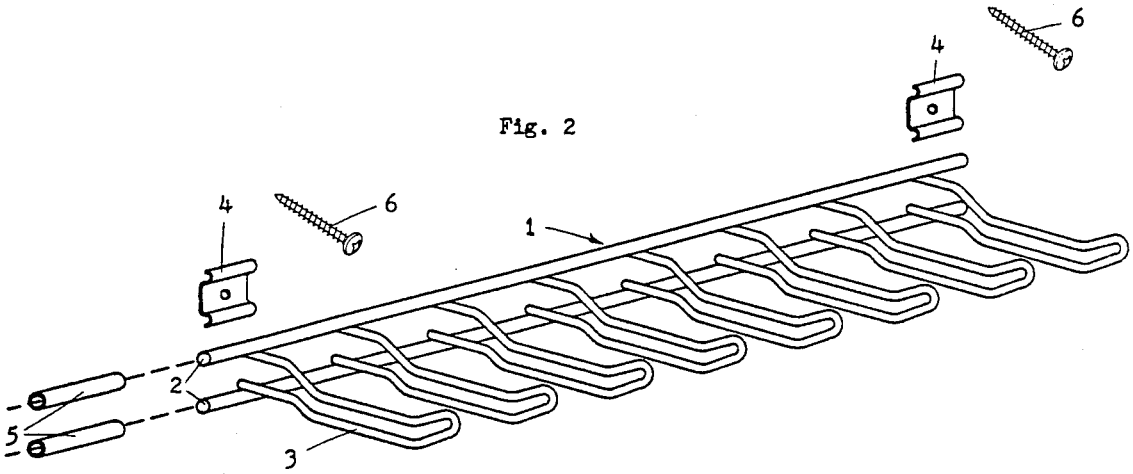
FIG. 2 shows a perspective side view of the individual parts.

FIG. 2 shows the individual parts. The hangers 3 are made from $\frac{1}{8}''$ wire $\times 11''$ long with a cradle formed in each end so that when the wire is bent 180° in it,s center the formed parts, top and bottom, are parallel to one another. Then the looped end of the hangers 3 are bent slightly, one to the left the next to the right, and welded onto the main body 2 parts with the bent ends facing one another. The main body 2 parts, two to a rack 1, are made from $\frac{1}{4}''$ wire $\times 18''$ long. The hanger 3 ends are spot welded to and inbetween the main body 2 parts at $2\frac{1}{4}''$ intervals with 8 hangers 3 to a rack 1. The mounting clips 4 are made from 10 gauge sheet metal $\times 1'' \times 2''$ and are curved on each end to fit over and secure the main body 2 parts 2" apart. The mounting clips 4 have a 3/16" hole in their center for the mounting screw to pass through.

The joiner tubes 5 are made from $\frac{1}{4}''$ I. D. steel tube $\times 2''$ long. The main body 2 parts are inserted into the joiner tubes 5 so as to extend the length of the rack 1 as needed.

Figure 3:
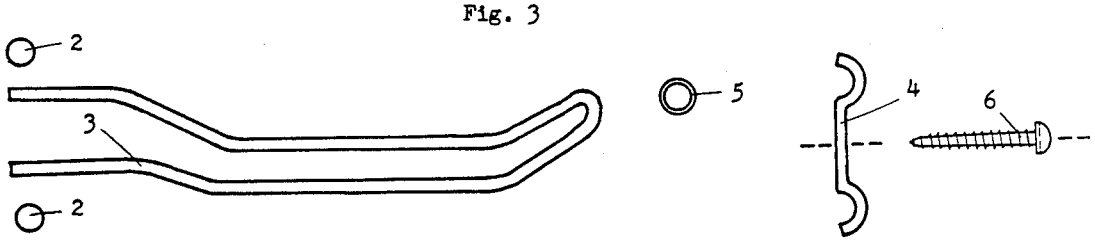
FIG. 3 shows a side view of the individual parts.

FIG. 3 shows a side view of the individual parts. The main body 2 parts weld above and below the hanger 3 ends.

Rack Operation

When boots are stored by hanging: wrinkles tend to stay out, the boots dry better, they can be kept up above clutter and scuffing, and can be nicely displayed.

I claim:

1. A rack for hanging boots that have side attached pullstraps, by said pullstraps for storage, protection, drying and display, said rack comprising: a pair of parallel, vertically spaced rods of equal length, a plurality of substantially V-shaped, equally spaced, arms having their free ends welded to said rods with the free ends of each arm in vertical alignment, the upper portion of each V-shaped arm containing a depression and the apex of said arms bent toward one another in pairs;

a pair of mounting brackets are provided at the respective ends of said pair of rods comprising flat members with raised portions to cover said rod ends, whereby said rack may be supported on a vertical surface by mounting attaching said flat members to said vertical surface; and connecting tubes for sliding over the ends of said rods for connecting a plurality of said racks in side by side relationship.

2. The rack of claim 1 would be made of plastic, wood, or metal.

* * * * *